US007146756B2

(12) United States Patent
Anderson

(10) Patent No.: US 7,146,756 B2
(45) Date of Patent: Dec. 12, 2006

(54) APPARATUS AND METHOD FOR DISPLAYING AN ITEM

(76) Inventor: Ryan C. Anderson, P.O. Box 17531, Beverly Hills, CA (US) 90209

( * ) Notice: Subject to any disclaimer, the term of this patent is extended or adjusted under 35 U.S.C. 154(b) by 180 days.

(21) Appl. No.: 10/866,439

(22) Filed: Jun. 12, 2004

(65) Prior Publication Data

US 2004/0261305 A1 Dec. 30, 2004

Related U.S. Application Data

(60) Provisional application No. 60/480,938, filed on Jun. 24, 2003.

(51) Int. Cl.
*G09F 1/00* (2006.01)

(52) U.S. Cl. ..... 40/124.06; 229/92.8; 40/771

(58) Field of Classification Search ..... 40/124.06, 40/754

See application file for complete search history.

(56) References Cited

U.S. PATENT DOCUMENTS 3,894,684 A * 7/1975 Florey ..... 229/92.8
4,343,105 A * 8/1982 Isaacson ..... 40/761
4,776,176 A * 10/1988 Vinz ..... 62/101
5,833,129 A 11/1998 Smith
6,237,837 B1 * 5/2001 Martin ..... 229/71

FOREIGN PATENT DOCUMENTS

FR 1541988 A 10/1968
FR 2509974 A 1/1983
FR 2796920 A 2/2001

* cited by examiner

*Primary Examiner*—Joanne Silbermann
(74) *Attorney, Agent, or Firm*—Berenato, White & Stavish

(57) ABSTRACT

A plurality of edges (106–110) of a transparent sheet (112) are adhered to a back (114) of a paper backing (116) to from a clear-front envelope (102). A support flap (104) is attached to the clear-front envelope (102) where the support flap (104) folds away from the clear-front envelope (102) at a fold line (126) and has an edge for resting a horizontal surface. A display item is secured between the paper backing (116) and the transparent sheet (112) and can be displayed in a landscape or portrait position. Postage indicia (1102) on the support flap (104) allows the display item to be mailed as a personalized postcard. Other indicia (1104) may further provide advertising or customize the display device (100).

22 Claims, 6 Drawing Sheets

APPARATUS AND METHOD FOR DISPLAYING AN ITEM

CROSS REFERENCE TO RELATED APPLICATIONS

This application claims the benefit of priority of U.S. Provisional application Ser. No. 60/480,938 filed on Jun. 24, 2003, entitled "Apparatus And Method For Displaying An Item" and which is incorporated by reference in its entirety herein.

BACKGROUND OF THE INVENTION

The invention relates in general to postcards and more specifically to an apparatus and method for displaying a planar item.

Picture display devices such as picture frames allow the presentation of a photograph or other planar item for easy viewing. Many picture frames can be placed on a flat surface such as table or desk such that the displayed item is positioned at a pleasing viewing angle. Conventional display devices, however, have several limitations. For example, many conventional designs partially obscure the displayed item with a frame or clip. Further, many conventional display devices are heavy, bulky, and relatively expensive. Many picture frames in include a glass panel to protect the displayed device and, therefore, may pose a danger if dropped or otherwise broken.

Postcards provide a mechanism for mailing a message along with a selected picture. Although the selected image may be attractive, humorous, or otherwise entertaining, available images are limited and are not personalized. Often the sending party would prefer to send a personal photograph rather than a generic postcard. Conventional techniques for mailing personal photographs include using an envelope, using a framed postcard device, and applying a sticker to the back of the photograph. Conventional mailing techniques, however, are limited in several ways. For example, some conventional techniques are limited in that the photograph is partially or completely obscured by the article used to mail the photograph. When a photograph is mailed in an envelope, the entire image is covered until the recipient opens the package. Other devices include a frame that covers a portion of the custom photograph or picture. In addition, conventional mailing products are limited in that the photograph or other displayed item can not be easily positioned for display. Mailed photographs must often be displayed by securing the photograph to vertical surface using tacks or magnets or by placing the photograph in a picture frame.

Accordingly, there is need for an apparatus and method for efficiently displaying a displaying a planer display item.

DETAILED DESCRIPTION OF THE PREFERRED EMBODIMENTS

In the exemplary embodiment of the invention, a foldable support flap is affixed to a paper backing of an envelope having a transparent front sheet to form a photograph display device. A user encloses a photograph or other thin, planar item to be displayed into a pocket formed between the transparent front sheet and the paper backing by sealing a seal flap of the transparent sheet to the paper backing. Any combination of indicia such as advertisements, decorative marking, and instructions may be included on either side of the transparent front sheet, the paper backing, and/or the support flap. In the exemplary embodiment, the display device includes postcard indicia such a stamp placement square and address lines allowing the display device to be used as a personalized postcard for mailing photographs or other display items. A user can easily insert a photograph, seal the display device and mail the display device. In addition to minimizing production costs, an efficient, integrated construction provides a durable display device that requires minimal manipulation and assembly by the user. Although the device may be used for mailing display items, the display device may be used solely as a safe, lightweight, and inexpensive picture frame that allows full view of the display item.

Figure 1:
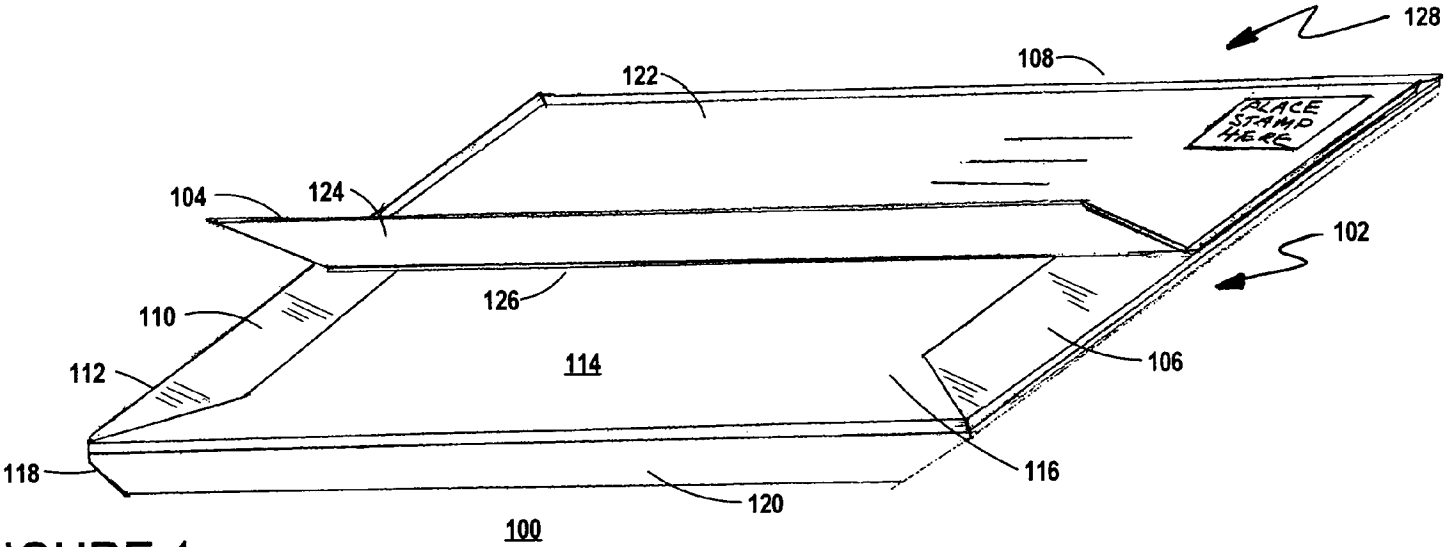
FIG. 1 is an illustration of a perspective view of an unsealed display device in accordance with the exemplary embodiment of the invention.

FIG. 1 is an illustration of a perspective view of an unsealed display device 100 in accordance with the exemplary embodiment of the invention. The display device 100 includes at least a support flap 104 connected to a clear front envelope 102. Although in the exemplary embodiment, the display device 100 has a rectangular shape, the display device 100 may be square, triangular, oval, circular or any other planer shape. The clear front envelope 102 is formed by adhering a plurality of edges 106–110 of a transparent plastic sheet 112 to a back 114 of a paper backing forming a first backing member 116. At least one sealing flap 118 of the transparent plastic sheet 112 is not adhered to the paper backing 116 until after a photograph or other display item is inserted into the clear front envelope 102. In the exemplary embodiment, the first edge 106, second edge 108 and third edge 110 are attached to the paper backing 116 with an adhesive. The sealing flap 118 includes a sealing strip 120 that allows the user to peal off a protective tape, fold the sealing flap 118 and adhere the sealing flap 118 to the back 114 of the paper backing 116 to seal the display item inside the clear front envelope 102 of the display device 100.

In the exemplary embodiment, the support flap 104 is formed from paper stock forming a second backing member that includes a connection portion 122 and a stand portion 124. The connection portion 122 is adhered to the back 114 of the paper backing 116 and to the transparent sheet edges 106, 108, 110 with adhesive that is applied at least along the perimeter of the connection portion 122. The connection portion 122 meets the stand portion 124 at a fold line 126. The stand portion 124 is folded away from the paper backing 114 when the display device 110 is used to display the display item on a horizontal surface (not shown). The display device 100 may be used to display the display item in a portrait or in a landscape position.

Figure 2:
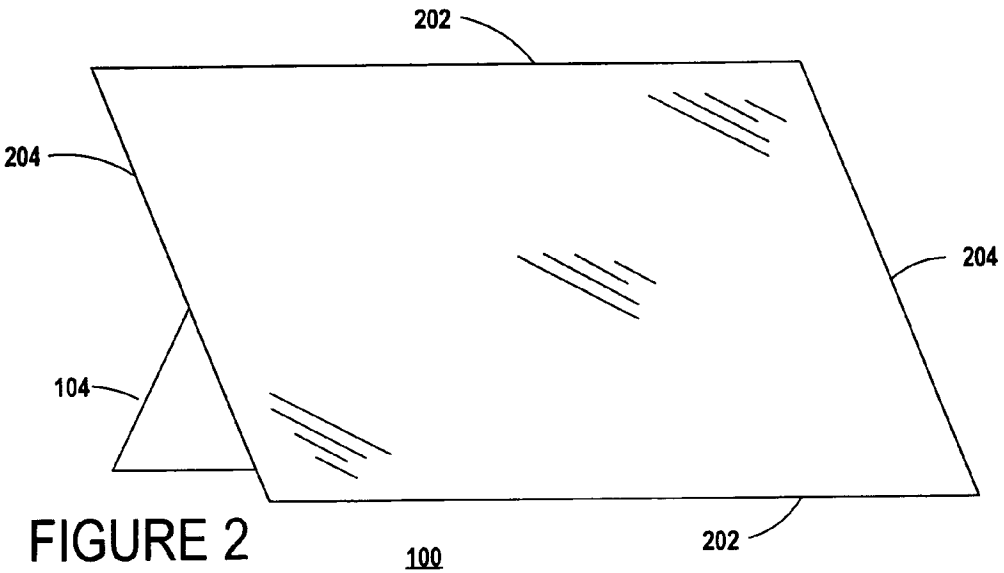
FIG. 2 is an illustration of a perspective view of the display device in use in a landscape orientation in accordance with the exemplary embodiment of the invention.
Figure 3:
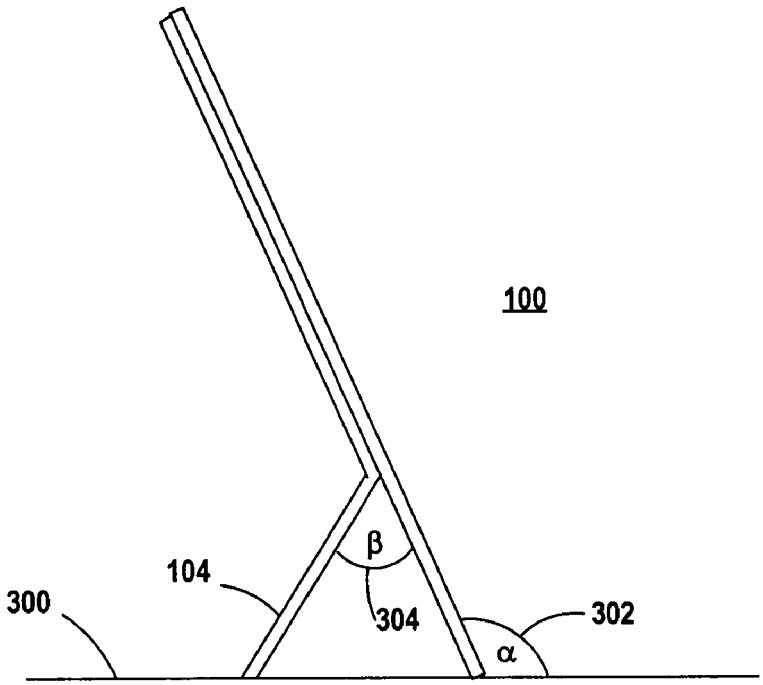
FIG. 3 is a block diagram of a side view of the display device in use in a landscape orientation in accordance with the exemplary embodiment of the invention.

FIG. 2 is an illustration of a perspective view and FIG. 3 is block diagram of a side view of the display device 100 in use in a landscape orientation in accordance with the exemplary embodiment of the invention. Where the display device 100 is designed to display rectangular display items, the display device 100 displays the display item in a landscape orientation by placing a long side 202 of the display device parallel to a horizontal flat surface 300 such as a desk or table. Neither of the short sides 204, therefore, rests on the horizontal surface 300 when the display device 100 is in the landscape orientation. The support flap 104 is folded back to the appropriate distance from the paper backing 116 by the user to set the desired viewing angle, α, 302 of the display item. As the support angle, β, 304 is increased, the viewing angle, α, 302 also increases allowing the display item to be more easily viewed form a higher elevation above the horizontal surface 300.

Figure 4:
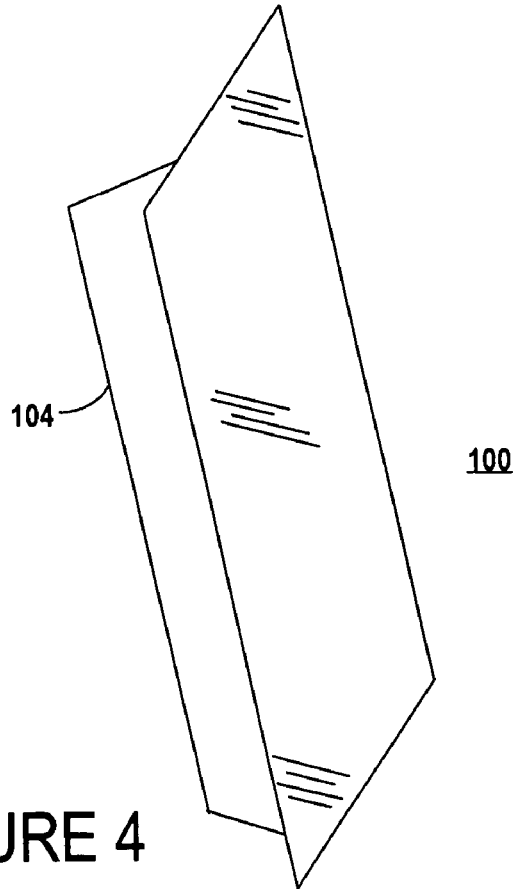
FIG. 4 is an illustration of a perspective view of the display device in use in a portrait orientation in accordance with the exemplary embodiment of the invention.
Figure 5:
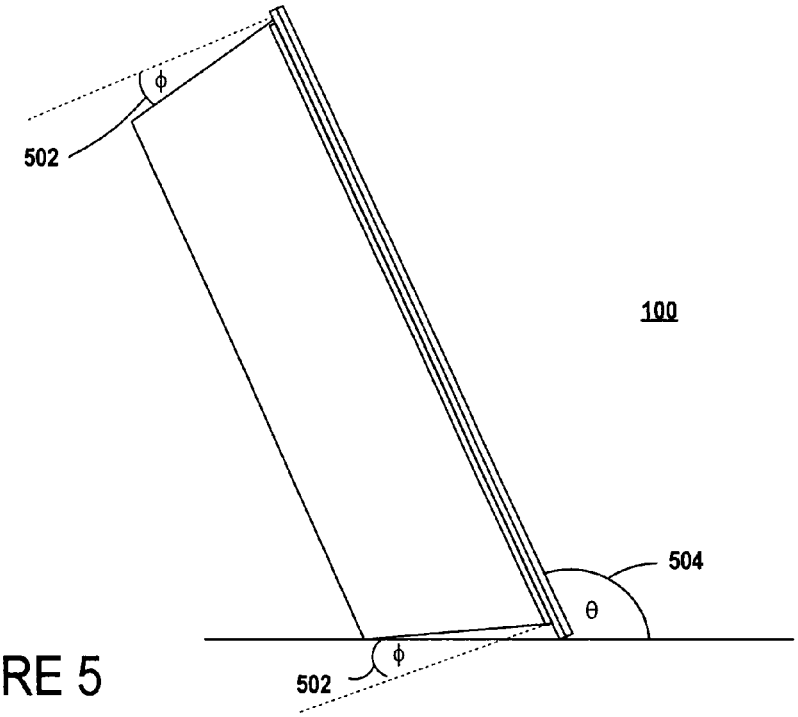
FIG. 5 is block diagram of side view of the display device in use in a portrait orientation in accordance with the exemplary embodiment of the invention.

FIG. 4 is an illustration of a perspective view and FIG. 5 is block diagram of side view of the display device 100 in use in a portrait orientation in accordance with the exemplary embodiment of the invention. Where the display device 100 is designed to display rectangular display items, the display device can be used to display the display item in a portrait orientation by placing either of the short sides 202 of the display device parallel to the horizontal flat surface. Neither of the long sides 204, therefore, rests on the flat surface when the display device is in the portrait orientation. The support flap 110 has a shape that allows the display device 100 to present the displayed item at an esthetically pleasing viewing angle, θ, 504 where the viewing angle, θ, 504 is the angle formed between the front face of the display item 100 and the horizontal surface 300. Although any viewing angle between 180 degrees and 90 degrees can be used, an example of a suitable viewing angle is 100 degrees. The viewing angle, θ, 504 is determined by the support flap cut angle, ϕ 502. In the exemplary embodiment, the support flap 104 is symmetrically cut at each edge to form support flap cut angle, ϕ, 502 of approximately 11 degrees relative to the short side of the display device 100.

Figure 6:
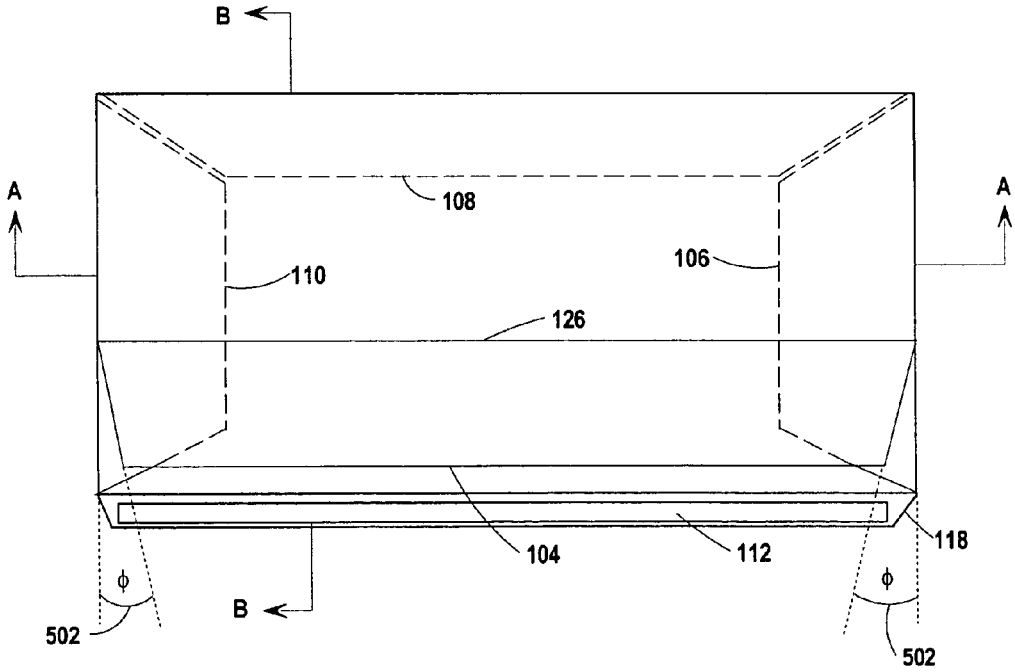
FIG. 6 is block diagram of a bottom view of an unsealed display device in accordance with the exemplary embodiment of the invention.

FIG. 6 is block diagram of a bottom view of the display device 100 in accordance with the exemplary embodiment of the invention. As discussed above, the display device 100 may have any one of several shapes. In the exemplary embodiment the display device has a shape configured to display a standard size photograph such as for example, 3 inch by 5 inch, 4 inch by 6 inch, 5 inch by 7 inch, and 8 inch by 10 inch photographs. Accordingly, a display device may be manufactured for each of the standard photograph sizes. The dimensions of the paper backing are slightly larger that the dimensions of the intended display item. The paper backing 116 should be large enough to allow the display item to be easily inserted into the clear front envelope 102 while having dimensions small enough to minimize any movement of the display item after it is sealed. Also, the dimensions should be chosen such that amount of paper backing bordering the display item is minimized. An example of suitable dimensions is having a length and width that is approximately one millimeter larger than the intended display item. In some circumstances the dimensions may be selected to cause the front clear panel to bow slightly outward.

As discussed above, the support flap is cut and angle, ϕ, that allows the display device 100 to have an appropriate viewing angle when positioned in the portrait display position. In the exemplary embodiment, the angles on the both sides of the support flap 104 are the same. In some circumstances, however, the angles may be different allowing the display device to have different viewing angles depending on which short side 204 is placed on the horizontal display surface.

Figure 7:
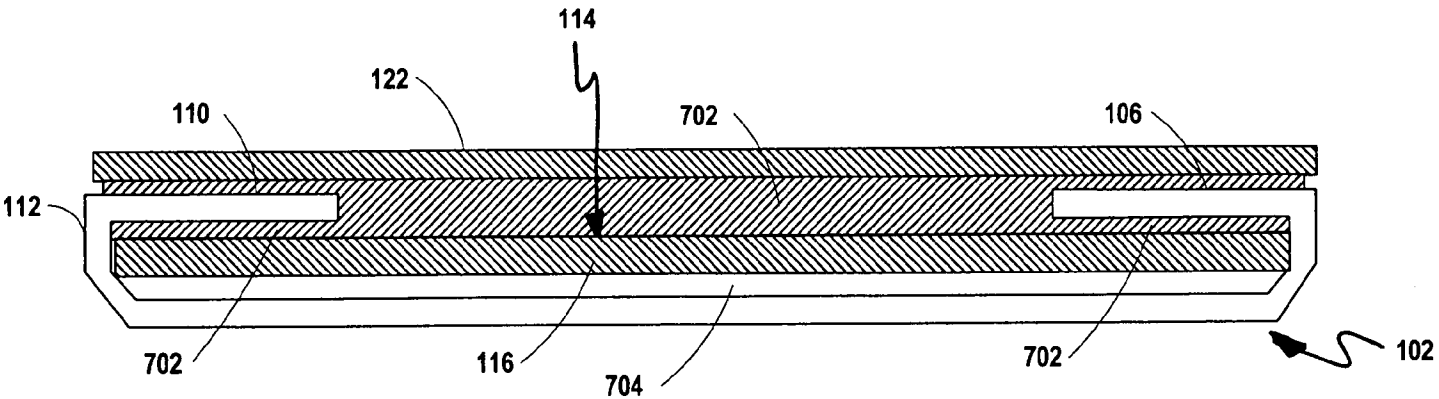
FIG. 7 is a block diagram of a cross section of the display device taken at line A—A of FIG. 6 in accordance with the exemplary embodiment of the invention.
Figure 8:
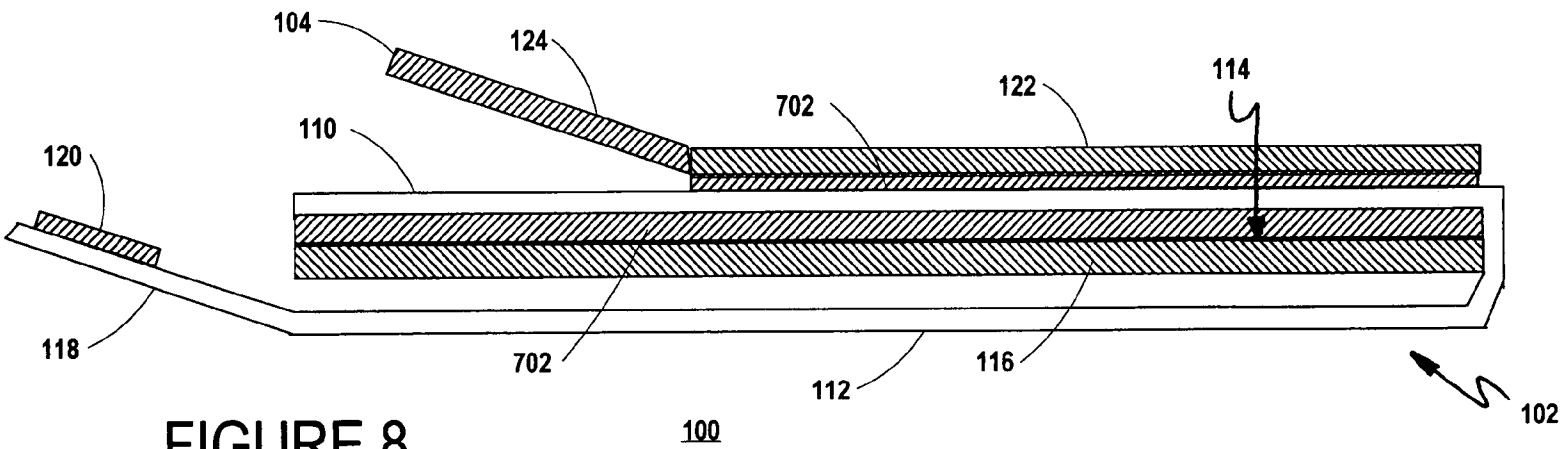
FIG. 8 is a block diagram of a cross section of the display device taken at line B—B of FIG. 6 in accordance with the exemplary embodiment of the invention.

FIG. 7 is a block diagram of a cross section of the display device taken at line A—A of FIG. 6 and FIG. 8 is a block diagram of a cross section taken at line B—B of FIG. 6 in accordance with the exemplary embodiment of the invention. The various sizes of the blocks illustrated in FIG. 7 and FIG. 8 are not necessarily to scale. Certain dimensions are exaggerated to more easily illustrate the structure of the exemplary embodiment. As described above, a plurality of edges 106, 110 of the transparent sheet 112 is adhered to the back 114 of the paper backing to form a clear front envelope 102. An adhesive 702, such as a spray adhesive, is applied the back 114 of the paper backing 116 and edges are wrapped around the paper backing 116 and attached to the adhesive 702. A pocket 704 is formed between the front of the paper backing and the transparent sheet 112. A display item such a photograph is inserted into the pocket 704.

Figure 9:
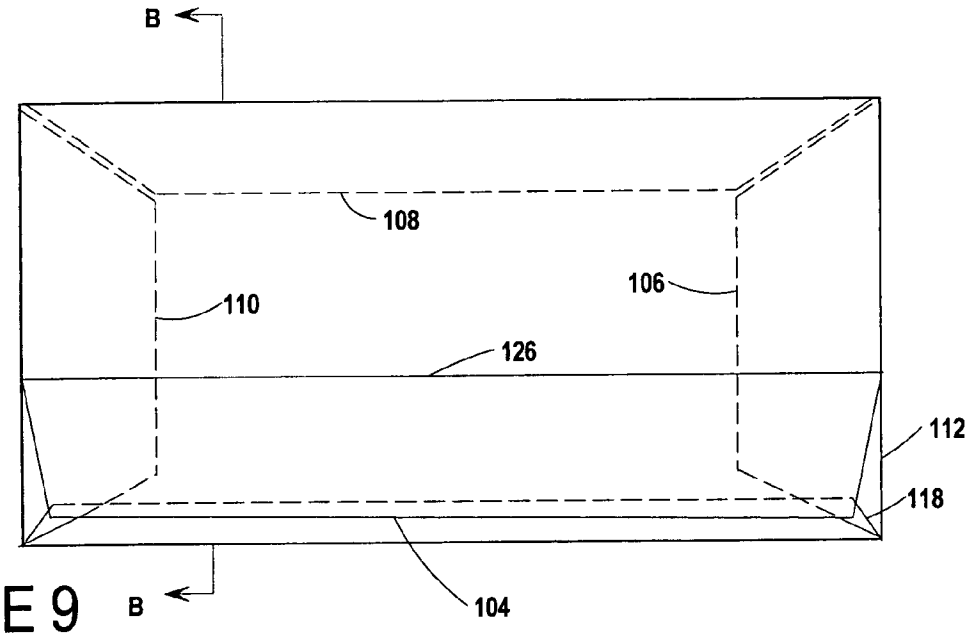
FIG. 9 is a block diagram of a bottom view of the display device where the sealing flap is sealed to enclose the display item.
Figure 10:
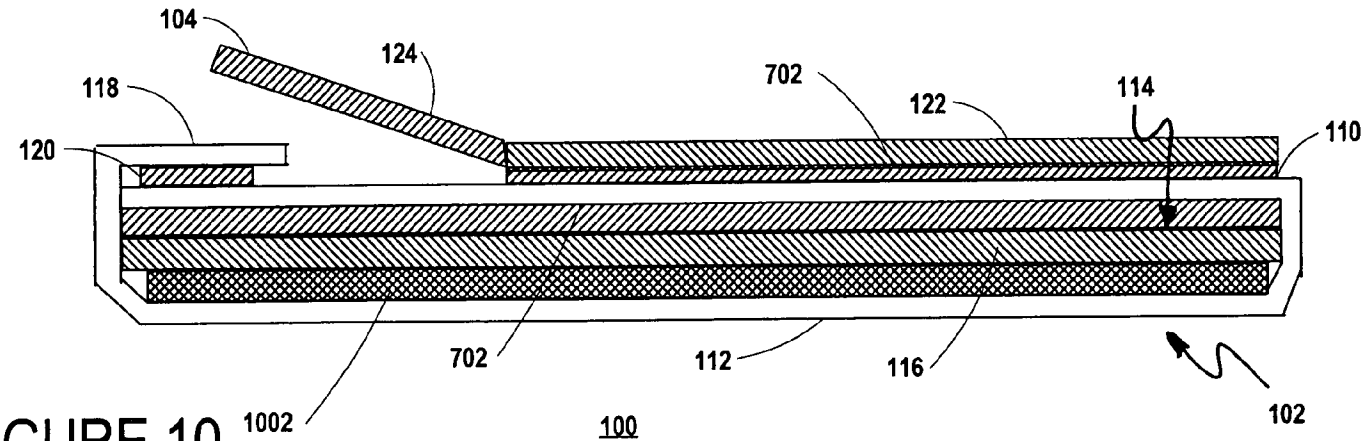
FIG. 10 is a block diagram of a cross section of the display device taken at line B—B of FIG. 9 in accordance with the exemplary embodiment of the invention.

FIG. 9 is a block diagram of a bottom view of the display device 100 where the sealing flap is sealed to enclose the display item. FIG. 10 is a block diagram of a cross section of the display device taken at line B—B of FIG. 9 in accordance with the exemplary embodiment of the invention. The various sizes of the blocks illustrated in FIG. 10 are not necessarily to scale. Certain dimensions are exaggerations to more easily illustrate the structure of the exemplary embodiment. After a display item 1002 such as a photograph is inserted in the pocket 704 of the clear front envelope 102 by the user, the sealing flap 118 is wrapped around and adhered to the paper backing 116. In the exemplary embodiment, a section of peal of adhesive tape forms the adhesive strip 120 on the sealing flap 118. Accordingly, the user removes a protective strip from the adhesive strip and presses the sealing flap 118 to the paper backing. User instructions in the form of printed indicia are included on the display device to assist the user in properly using the display device 100 as a display device and a personalized postcard mailer. The instructions may include directions on applying the sealing flap to the paper backing 116 and not to the support flap 104.

Figure 11:
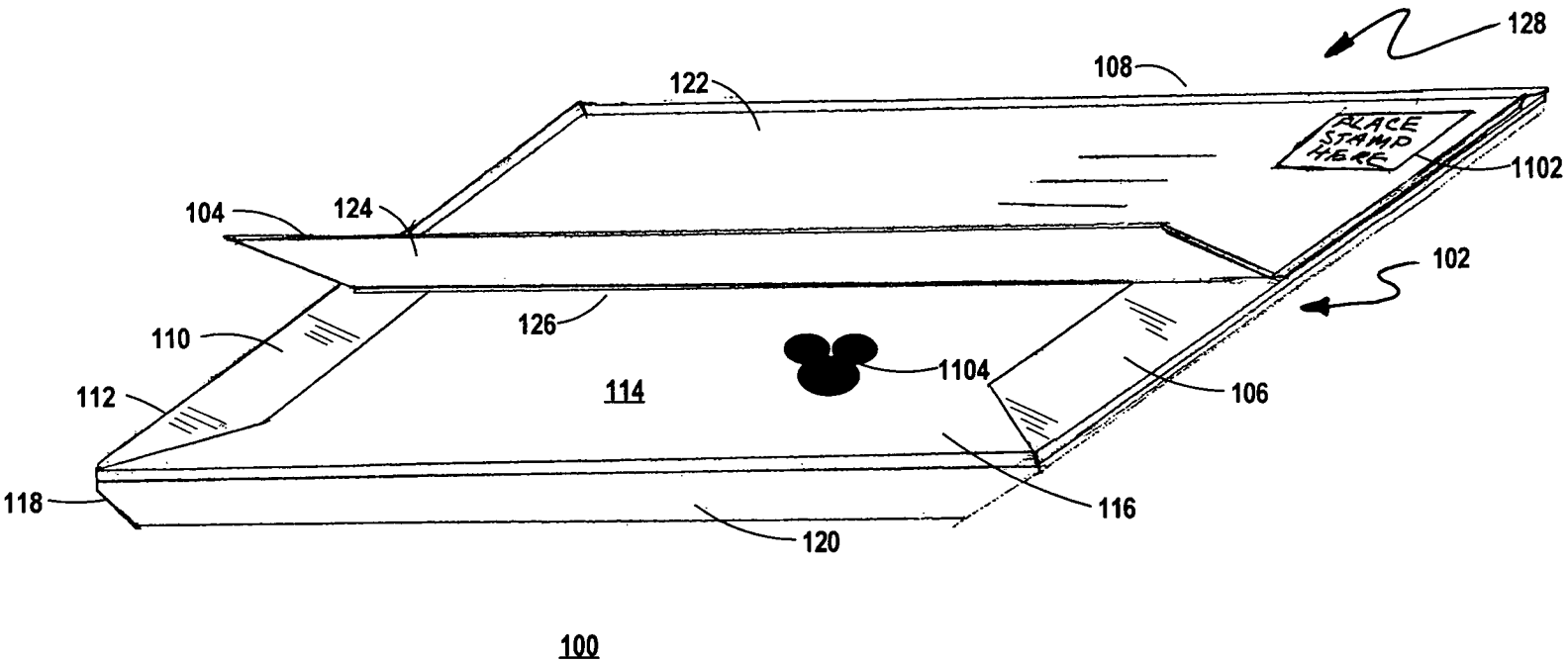
FIG. 11 is an illustration of a perspective view of an unsealed display device including indicia in accordance with the exemplary embodiment of the invention.

FIG. 11 is an illustration of a perspective view of an unsealed display device 100 with indicia 1102, 1104 in accordance with the exemplary embodiment of the invention. Indicium indicating the appropriate location for postage 1102 is printed on the connection portion 122 of the support flap 104. In some situations, the postage may be provided on the display device 100. In addition to postcard indicia 128, the display device includes other indicia 1104 on one or more components of the display device 100 in the exemplary embodiment. For example, the indicia 1104 such as advertising indicia, decorative indicia, logos, letters, numbers, symbols, or other types of printed or etched items may be included on the transparent sheet 112, the paper backing 116, the sealing flap 118, or the support flap 104. When included on the back side of the display device 100, the indicia 1104 may be printed on the connection portion 122 of the support flap 104, on the stand portion 124 of the support flap, or on the paper backing 114 as well as on any portion of the sealing flap 118 or the transparent sheet edges 106, 108, 110. In some circumstances, the indicia 1104 may be included on the transparent sheet 112 such that it can be viewed when the display item 1002 is sealed with the clear front envelope 102. Etching techniques may be used to form a logo, lettering or other design on the front face of the clear front envelope 102 to allow the display item to be viewed with minimal interference. In some circumstances, the indicia 1104 may be included on the front of the paper backing 116 such that it can be viewed through the clear front envelope 102 before a display item 1002 is inserted. For informational or decorative purposes, the display item 100 may include other features by using particular materials such as colored paper stock or colored transparent sheets 112.

In the exemplary embodiment, the indicia 1104 is printed using a four color printing process on the back of the display device 100. Although other types of materials may be used, the paper stock used to form the paper backing 114 and the support flap 104 is a material compatible with four color printing processes. Accordingly, the indicia 1104 may be a high quality color photograph in some circumstances.

The indicia 1104 may be a generic decorative designs or images such as representations, for example, of historical or natural landmarks, seasonal or holiday depictions, or religious symbols. The representations may include any level of complexity and color and may be full color photos such as traditional photos found on postcard or may be single color sketch. For example, the back of the display device 100 may include a full color photograph of a beach or may simply include a single color image of a palm tree to express a vacation theme. Examples of holiday and seasonal indicia include depictions of Christmas trees, Santa Claus, hearts, clovers, snowmen, flags, winter scenes, flowers, witches, pumpkins, turkeys, colored leaves, as well as text.

In some situations the indicia 1104 may express an invitation to an event such as a party or wedding and may include customized information. For example, the indicia 1104 may include date, time, location and other event specific information.

The display device may be used as a promotional mechanism or for advertising. For example, company logos, names, slogans, trademarks and other company identifiable symbols may be etched or printed in the clear envelope 102 or on the back of the display device 100. The promotional aspects of the exemplary display device 100 may be particularly useful at theme parks where symbols or marks may indicate the source of the picture. For example, an image of famous whale may be included on the display device to indicate that a photograph contained in the display device was taken at an aquatic adventure park. Further, famous cartoon characters may enhance the attractiveness of the display device when sold or otherwise provided at a well known theme park associated with those characters.

The display device may form a collectable souvenir when combined with a photograph taken at an event or location represented by indicia 1104. For example, theme park personnel may take photos of patrons and provide the photograph in a display device 100 including indicia 1104 indicative of the theme park to generate a custom souvenir for the patron. Further, a display device 100 may include indicia representing an event such as a wedding or birthday party. Candid or portrait photographs taken at the event may mailed to the attendees using the display device 100 to form a collectable souvenir that can be displayed.

In some circumstances, a thin planer magnet is attached to the display device 100 to allow the display device to be mounted on a metal surface such as a refrigerator. A suitable technique for attaching a magnet includes sealing a strip of thin, planar magnetic material between the paper backing and the connection portion 122 of the support flap 104.

The display device 100, therefore, allows a display item such a photograph to be displayed in a either a landscape or portrait orientation. The clear front envelope 102 formed by the paper backing 116 and the transparent sheet 112 secures the display item 1002 without obscuring the image with a frame. The display device 100 is easy to use as a inexpensive, safe picture frame and also as a convenient envelope for forming a personalized postcard.

Clearly, other embodiments and modifications of this invention will occur readily to those of ordinary skill in the art in view of these teachings. The above description is illustrative and not restrictive. This invention is to be limited only by the following claims, which include all such embodiments and modifications when viewed in conjunction with the above specification and accompanying drawings. The scope of the invention should, therefore, be determined not with reference to the above description, but instead should be determined with reference to the appended claims along with their full scope of equivalents.

What is claimed is:

1. A display device comprising:

a transparent sheet having four perimeter edges, a first backing member adhered to said transparent sheet by folding three of said four perimeter edges of said transparent sheet around corresponding edges of said first backing member to thereby form a clear-front envelope configured to receive a display item; and a second backing member adhered to said first backing member, wherein said second backing member comprises a support flap attached to the clear-front envelope, the support flap configured to fold at fold line adjacent to the clear-front envelope and having an end for resting on a horizontal surface to support the clear-front envelope at a viewing angle to the horizontal surface, and wherein the clear front envelope is closed by folding a fourth edge of said four perimeter edges around said first backing member to retained a display object within said clear front envelope.

2. A display device in accordance with claim 1, wherein the second backing member comprises:

a connection portion adhered to the clear-front envelope; and the support flap attached to the connection portion at the fold line parallel to said fourth edge and foldable away from the clear-front envelope.

3. A display device in accordance with claim 2, wherein the connection portion comprises postal indicia indicating a preferred location for a postage stamp.

4. A display device in accordance with claim 3, wherein the postal indicia comprises a plurality of address lines.

5. A display device in accordance with claim 1, further comprising indicia.

6. A display device in accordance with claim 5, wherein the indicia is disposed on the transparent sheet.

7. A display device in accordance with claim 5, wherein the indicia is disposed on the second backing member.

8. A display device in accordance with claim 5, wherein the second backing member is paper.

9. A display device in accordance with claim 5, wherein the indicia is disposed on the connection portion of the second backing member.

10. A display device in accordance with claim 5, wherein the indicia is a photograph.

11. A display device in accordance with claim 5, wherein the indicia is etched onto the display device.

12. A display device in accordance with claim 5, wherein the indicia is advertising indicia.

13. A display device in accordance with claim 12, wherein the advertising indicia is a logo of a company.

14. The display device in accordance with claim 1, wherein said second backing member being adhered to a portion of said three edges of said transparent sheet which are folded around said corresponding edges of said first backing member to thereby create said support flap.

15. A borderless display device for displaying a planar displayed item, the display device comprising:

a clear-front envelope formed by a transparent sheet partially folded around a first backing member leaving an opening and forming a borderless display window for receiving and displaying the planar displayed item, the opening at least partially closed when a sealing flap of the transparent sheet is secured to the first backing member such that the first backing member is co-extensive with the borderless display window; and a support flap attached to the first backing member, the support flap configured to fold at fold line adjacent to the clear-front envelope and having an end for resting on a horizontal surface to support the clear-front envelope at a viewing angle to the horizontal surface.

16. A display device in accordance with claim 15, further comprising indicia.

17. A display device in accordance with claim 16, wherein the indicia is printed on the first backing member.

18. A display device in accordance with claim 16, wherein the indicia is printed on the transparent sheet.

19. A display device in accordance with claim 16, wherein the indicia is printed in the support flap.

20. A display device in accordance with claim 15, wherein said support flap is formed by a second backing member partially adhered to at least one of said first backing member and said transparent sheet and wherein said support flap is parallel to an edge defined by said sealing flap.

21. A method of displaying a planar display item, the method comprising:

inserting the planar item into a clear-front envelope formed by a transparent sheet folded on three sides around a backing member leaving an opening for receiving the planar display item, folding a sealing flap along a sealing fold line of the transparent sheet toward the backing member;

securing the sealing flap to the paper backing to at least partially close the opening and form a borderless viewing area co-extensive with the planar dimensions of the backing member;

folding, at a support fold line, adjacent to the clear-front envelope, a stand portion of a support flap away from the backing member; and resting an end of the support flap on a horizontal surface to support the clear-front envelope at a viewing angle to the horizontal surface.

22. The display device in accordance with claim 21, wherein said support fold line is parallel to said sealing fold line.

* * * * *